US005327971A

United States Patent [19]

Garbutt et al.

[11] Patent Number: 5,327,971

[45] Date of Patent: Jul. 12, 1994

[54] PRESSURE RECORDER CARRIER AND METHOD OF USE

[75] Inventors: Charles F. Garbutt; David E. Ellwood, both of Midland, Tex.

[73] Assignee: Marathon Oil Company, Findlay, Ohio

[21] Appl. No.: 962,767

[22] Filed: Oct. 19, 1992

[51] Int. Cl.[5] ..... E21B 47/00

[52] U.S. Cl. ..... 166/250; 166/308; 166/372

[58] Field of Search ..... 166/55.1, 68, 250, 308, 166/372

[56] References Cited

U.S. PATENT DOCUMENTS

| | | | |
|---|---|---|---|
| 4,392,376 | 7/1983 | Lagus et al. | 73/155 |
| 4,453,595 | 6/1984 | Lagus et al. | 166/250 |
| 4,480,690 | 11/1984 | Vann | 166/250 |
| 4,509,604 | 4/1982 | Upchurch | 166/297 |
| 4,510,797 | 4/1985 | Guidry et al. | 166/250 |
| 4,624,309 | 11/1986 | Schnatzmeyer | 166/250 |
| 4,660,638 | 4/1987 | Yates, Jr. | 166/55.1 |
| 4,898,244 | 2/1990 | Schneider et al. | 166/55.1 |
| 4,979,563 | 12/1990 | Patel | 166/250 |
| 4,986,350 | 1/1991 | Czernichow | 166/65.1 |
| 5,130,705 | 7/1992 | Allen et al. | 166/250 |
| 5,186,048 | 2/1993 | Foster et al. | 166/250 |

OTHER PUBLICATIONS

"Hydraulic Fracturing", pp. 130–136, by Howard et al, SPE of AIME, 1970.

"The Technology of Artificial Lift Methods", by Brown, Petroleum Publishing Co., pp. 9–11.

*Primary Examiner*—Thuy M. Bui

*Assistant Examiner*—Frank S. Tsay

[57] ABSTRACT

A means for taking pressure readings in a bottom-hole zone of a well without interfering with an operation in which solid material is moving through a tubing string. A pressure recorder is enclosed in a carrier attached to the outer surface of a tubing sub near the end of the tubing string. The carrier walls include ports which expose the pressure recorder to the fluid in the bottom-hole zone. This arrangement allows operations such as sand fracture stimulations and rod pumping to be unimpeded by a pressure recorder.

7 Claims, 2 Drawing Sheets

PRESSURE RECORDER CARRIER AND METHOD OF USE

FIELD OF THE INVENTION

This invention relates to the collection of bottom-hole pressure data. More particularly, it relates to the use of a particular type of pressure recorder carrier suitable for use in collecting bottom-hole pressure data during operations such as fracture stimulation of a subterranean formation or a rod pumped well test.

BACKGROUND OF THE INVENTION

One of the means of improving oil well production is to increase the permeability of the subterranean formation of interest. The treatment method selected depends upon the type of formation encountered and may involve opening clogged pores, crevices and other flow channels in the formation or fracturing the formation to create cracks which are then propped open with sand or gravel.

In order to fracture stimulate a well, a packer is set above the zone of interest in order to isolate the well casing from extremely high working pressures. Because the packer seals off the annulus between the casing and the tubing string, it is not possible to collect bottom-hole pressure data from the annulus. This leaves two other ways of collecting such data. One is to support a pressure recorder on a wireline and place it in the tubing string near the zone of interest. While this procedure permits collection of bottom-hole pressure data during acid stimulations and during informational or data fracture stimulations in which no sand is introduced, it is not practical during sand fracturing. The pumping of sand proppant at high rates and pressures down the tubing string creates a sandblasting effect which is detrimental to a recorder in the tubing string. Moreover, the presence of a recorder in the tubing string creates a restriction in the tubing, which causes pressure differentials above and below the recorder that can affect the success of the stimulation.

The other way of collecting pressure data is to place the recorder in an isolated joint of the tubing string below a perforated tubing sub. Problems also exist with this method. Collection of bottom-hole pressure data can be carried out during acid stimulations and data fracture stimulations but not during actual fracture stimulations, inasmuch as sand collecting in the dead joint between the recorder and the dead joint interferes with the pressure recording. An added problem is the difficulty in retrieving the recorder through the packed sand after the stimulation operation.

Another area of activity in which it is difficult to collect bottom-hole pressure data is in rod pumping wells, where the use of a pressure recorder on a wireline can interfere with the operation of the pump and movement of the rods.

It would be desirable to be able to collect bottom-hole pressure data in the environments discussed without interfering with the ongoing activity of the operation and without diminishing the accuracy of the pressure recorder. It would also be desirable to accomplish this by relatively simple, economical means which does not require lengthy set-up procedures.

BRIEF SUMMARY OF THE INVENTION

The method of the invention is applicable to the collection of bottom-hole pressure data in a well containing a tubing string in which solid material is moving, such as proppant in fracture stimulation operations and a rod in the operation of rod pumping wells. Briefly, the invention involves attaching a pressure recorder carrier to the outer surface of the tubing string in the bottom-hole region of the well, providing fluid communication from the bottom-hole region of the well to the interior of the pressure recorder carrier, placing a pressure recorder in the carrier and collecting pressure data with the pressure recorder. The pressure recorder carrier is constructed to allow access of fluids from the bottom-hole region to the recorder and is designed for ease of movement into and out of the wellbore. The location of the pressure recorder keeps the recorder from interfering with the introduction of proppant during a fracture stimulation operation or with the rod and pump in a rod pumping well. It further protects the recorder against damage while maintaining the accuracy and integrity of the recording activity.

These and other features of the invention, as well as its various benefits, will be made more clear in the detailed description of the preferred embodiments below.

DETAILED DESCRIPTION OF THE PREFERRED EMBODIMENTS

Figure 1:
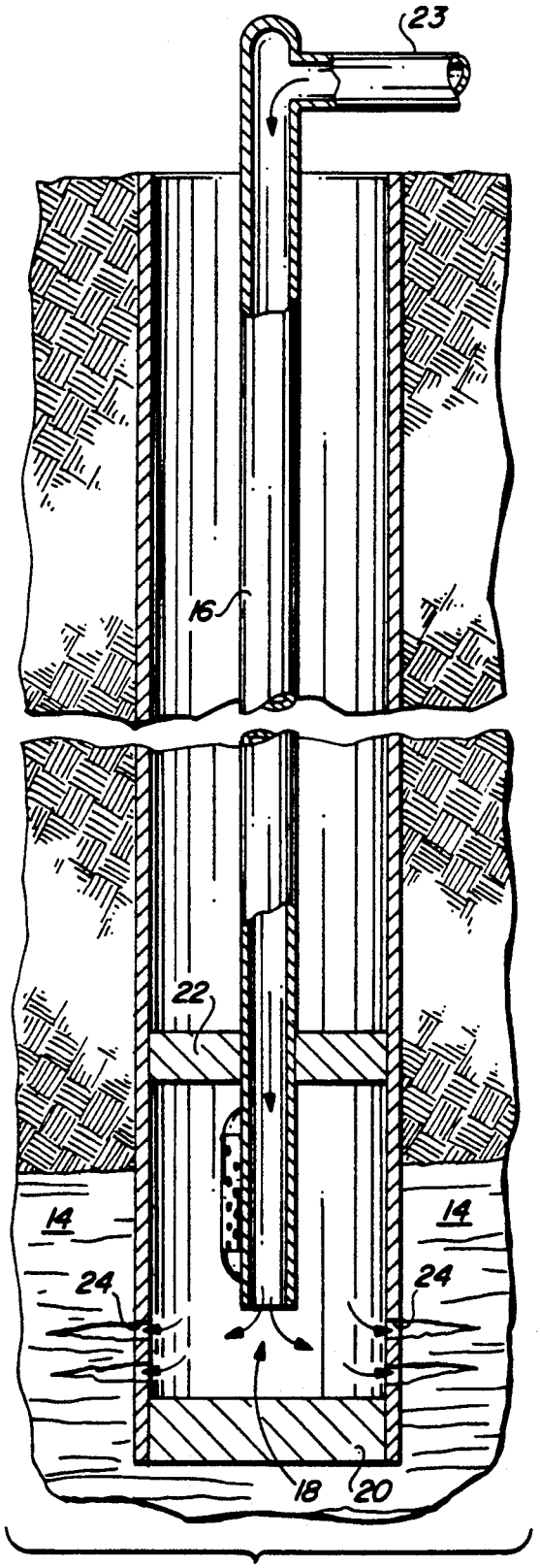
FIG. 1 is a simplified longitudinal sectional view of an oil well incorporating the pressure recorder carrier of the invention during a fracture stimulation process.

Referring to FIG. 1, one aspect of the invention is illustrated in connection with a fracture stimulation operation in an oil well. The well is defined by wellbore 10 and casing 12 which extend from the surface down to the formation of interest 14. Although not shown since it has no bearing on the invention, the casing will normally be cemented to the wellbore. A tubing string 16 extends from the surface down to a bottom-hole zone 18, defined at its lower extent by the packer 20, which for the purpose of the invention may be considered to be the bottom of the wellbore or an intermediate packer at the lower end of a formation interval of interest. The tubing string extends through packer seal 22 which has been run in on the tubing string and set above the zone of interest 14 in order to isolate the casing 12 from the extremely high working pressures of a fracture stimulation operation. It can be seen that because of the presence of the packer 22, there is no possibility of collecting bottom-hole pressure data from the zone of interest through the annulus between the tubing string 16 and the casing 12.

In a typical proppant fracture stimulation method, a mixture of fracture stimulation fluids and sand or other proppant is pumped, as indicated by the flow arrows, through surface piping 23, down through the open-ended tubing string 16 to the bottom-hole zone 18 and out casing apertures 24 into the formation of interest. As pointed out earlier, if a pressure recorder is supported by a wireline within the tubing string near the open end, the sand particles tend to interfere with the operation of the device and the recorder in the tubing acts as a restriction, causing pressure differentials above and below the recorder. According to the invention, a pressure recorder 26 is contained in a carrier or side-pocket 28 attached to the outer surface of the tubing string adjacent the bottom end of the string.

Figure 2:
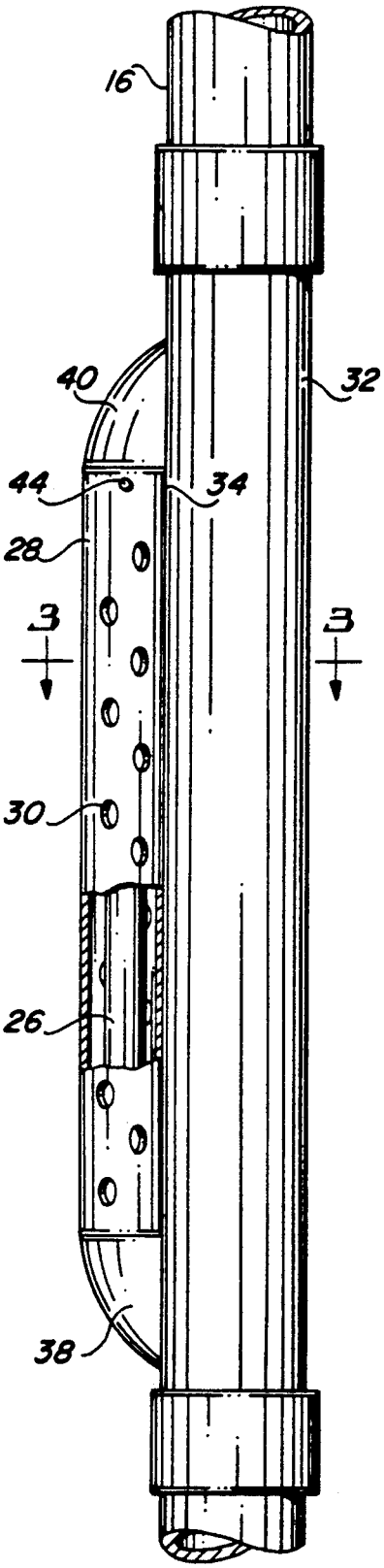
FIG. 2 is an enlarged side elevation of a portion of the tubing string of FIG. 1, with the pressure recorder carrier shown partially in section.
Figure 3:
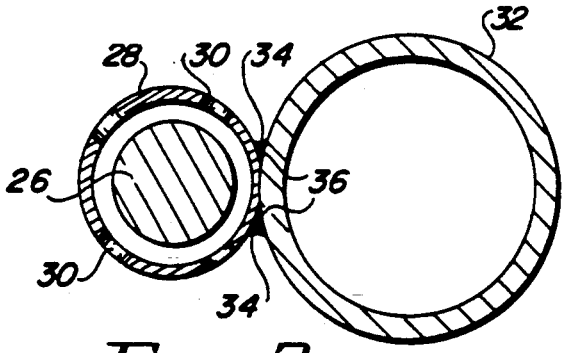
FIG. 3 is a sectional view taken on line 3—3 of FIG. 2.
Figure 4:
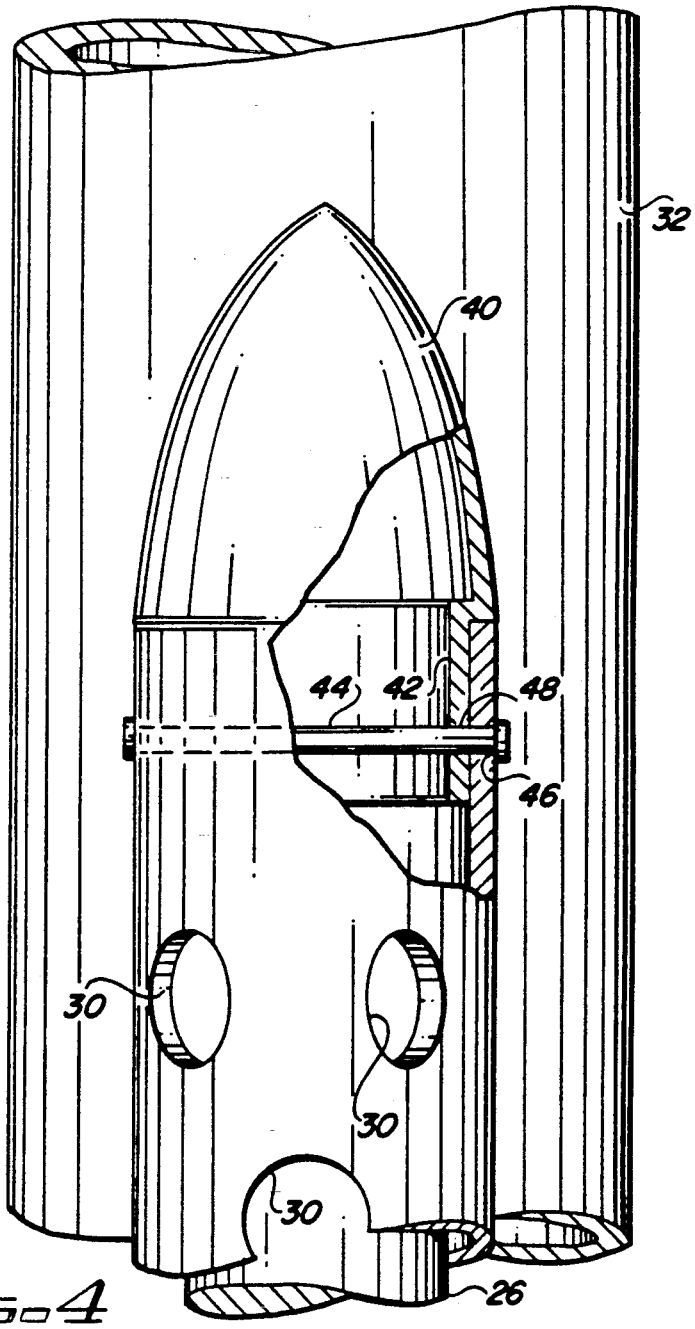
FIG. 4 is an enlarged partial side elevational view of the upper portion of the pressure recorder carrier, with the top cap shown partially in section.

The recorder carrier 28 is illustrated in more detail in FIGS. 2 and 3, which show the substantially tube-shaped carrier as having ports 30 in the carrier wall. The carrier is attached to a sub 32 of the tubing string 16, as by welds 34. Preferably, the carrier is formed from a tube which has been slit lengthwise so as to form two longitudinal edges 36. The edges are abutted against the wall of the tubing sub 32 and the assembly is welded together by welds 34. The lower end 38 of the carrier is provided with a tapered configuration, as by decreasing the radius of the end portion toward the end of the carrier. This provides a smooth or streamlined profile which allows for easy insertion of the carrier into the wellbore. The upper end of the carrier comprises a cap 40 shaped like the lower end of the carrier to allow for easy retrieval of the carrier out of the wellbore. The cap may be secured to the carrier by any desirable means which permits ready insertion of the recorder. In the arrangement illustrated in FIG. 4, the cap has a reduced neck 42 that fits into the upper end of the carrier and is secured in place by a pin 44 extending through aligned holes 46 in the carrier and holes 48 in the cap neck.

In operation, fracture stimulation fluid and proppant are pumped through the tubing workstring 16 and into the zone of interest via apertures 24 in the casing 12. The carrier 28 and its contained pressure recorder 26 are out of the direct flow of the fluid and proppant and so do not interfere with the operation, nor is the recorder interfered with by the flow. The ports 30 in the carrier, which may readily be provided by drilling, allow free pressure communication with the pressure recorder, permitting accurate pressure readings to be obtained.

Figure 5:
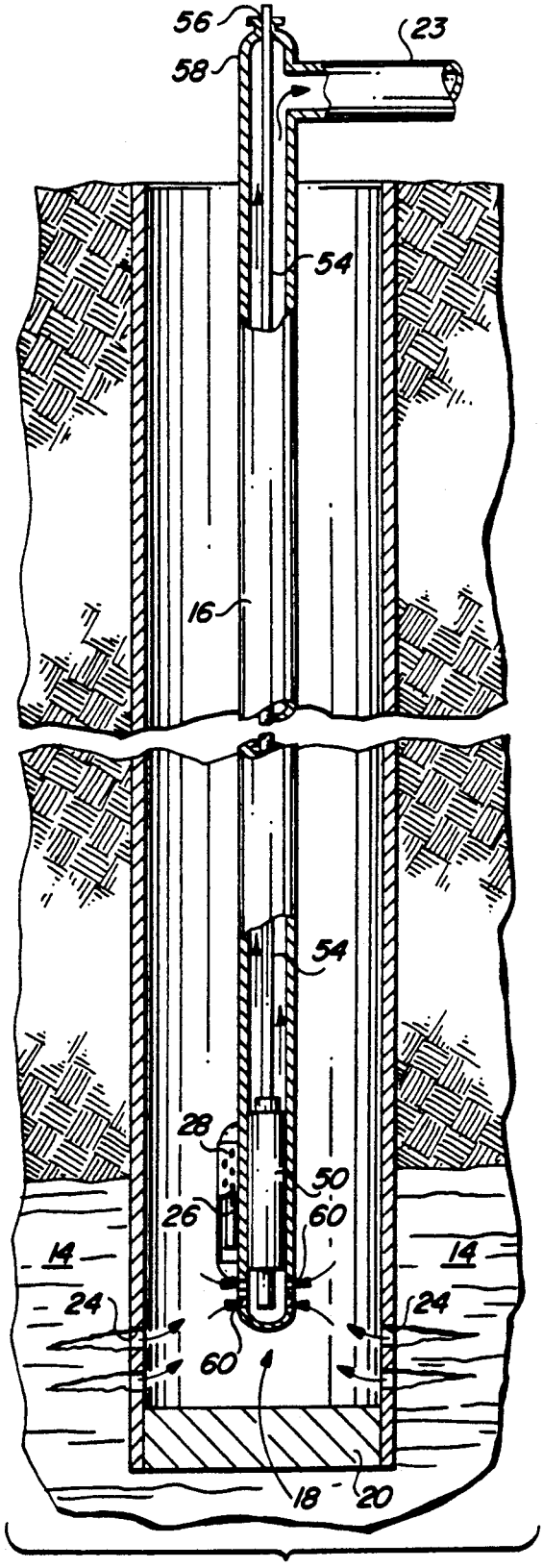
FIG. 5 is a simplified longitudinal sectional view of an oil well incorporating the pressure recorder carrier of the invention during a test on a rod pumped oil well.

Another aspect of the invention is illustrated in FIG. 5, wherein like reference numerals to those in FIG. 1 indicate like elements. In this operation a pump 50 is located in the lower end of the tubing string 52, and a rod string 54 connected to the pump extends up through the tubing string and out the opening 56 of an upper extension 58 of the tubing string to a prime mover, not shown, that reciprocates the rod string. Well fluid is pumped from the bottom-hole zone 18 through openings 60 in the lower end of the tubing string 52 and up the tubing string to the piping 23, which delivers it to surface facilities, not shown.

The same pressure recorder carrier described in connection with the fracture stimulation process is attached to a tubing sub in this arrangement for the purpose of obtaining pressure data during a test of the oil well. The location of the recorder carrier 28 safely positions the pressure recorder 26 away from the rod and pump, thereby protecting the recorder from damage and preventing interference with the recording operation.

Obviously, the size of the side-pocket may vary depending upon the size of the recorder, but a size providing for a snug fit of the recorder is preferred. The number and size of the ports in the recorder carrier wall may also vary, but should be such that the carrier wall is not excessively weakened by the drilled ports and will not restrict access of the recorder to the full pressure of the fluid in the bottom-hole zone.

As will now be appreciated, the invention provides a simple but highly effective means for accurately recording pressures during bottom-hole operations which normally are not conducive to the taking of such pressure readings, such as operations in which solid material is moving through a tubing string. In addition, the invention eliminates the risk of interfering with the operations themselves.

It should now also be clear that although preferred embodiments of the invention have been described, it is possible to make changes to certain specific details of the preferred embodiments without departing from the spirit and scope of the invention, as defined in the appended claims.

What is claimed is:

1. A method of collecting bottom-hole pressure data in a well in which a fracture stimulation operation is being carried out, comprising:

attaching a pressure recorder carrier to the outer surface of a portion of a tubing string intended to extend into the bottom-hole region of the well;

providing fluid communication means between the exterior and interior of the pressure recorder carrier so as to expose the interior of the carrier to pressure in the bottom-hole region;

placing a pressure recorder in the carrier;

introducing the tubing string into the bottom-hole region of the well adjacent a zone of interest;

providing a packer through which the tubing string extends, the packer sealing the annulus between the tubing string and the sidewall of the well above the zone of interest;

causing proppant particles and treatment fluid to flow downwardly through the tubing string and into the zone of interest; and collecting bottom-hole pressure data with the pressure recorder.

2. The method of claim 1, wherein the carrier comprises an elongated container attached to and substantially parallel with a sub of the tubing string, the fluid communication means comprises a plurality of ports in a wall of the container and the container further includes tapered end portions for providing a streamline configuration.

3. A method of collecting bottom-hole pressure data in a well in which fluid is being pumped from a bottom-hole zone, the well containing a tubing string extending down to the bottom-hole zone and in which a rod string is reciprocating, the rod string being connected to a pump located in the tubing string in the bottom-hole zone, comprising:

attaching a pressure recorder carrier to the outer surface of a portion of a tubing string intended to extend into the bottom-hole region of the well;

providing fluid communication means between the exterior and interior of the pressure recorder carrier so as to expose the interior of the carrier to pressure in the bottom-hole region;

placing a pressure recorder in the carrier;

introducing the tubing string into the well;

introducing a pump and rod string into the tubing string;

actuating the pump to pump fluid from the bottom-hole zone; and collecting bottom-hole pressure data from the pressure recorder.

4. The method of claim 3, wherein the carrier comprises an elongated container attached to and substantially parallel with a sub of the tubing string, the fluid communication means comprises a plurality of ports in a wall of the container and the container further includes tapered end portions for providing a streamline configuration.

5. In a well containing a tubing string in which solid material is moving, the tubing string extending down to a bottom-hole region in which it is desired to collect bottom-hole pressure data, the improvement comprising:

a pressure recorder carrier attached to the outer surface of the tubing string in the bottom-hole region of the well;

the pressure recorder carrier being comprised of an elongated container attached to a tubing sub, the container including a wall having a plurality of ports therein permitting fluid from the bottom-hole region of the well to flow to the interior of the pressure recorder carrier, the pressure recorder carrier having end portions of streamline configuration; and a pressure recorder in the carrier.

6. The improvement of claim 5, wherein the carrier is comprised of a substantially tubular container of less diameter than that of the tubing string, the substantially tubular container extending substantially parallel to the tubing string and being welded to the tubing sub.

7. The improvement of claim 6, wherein the substantially tubular container comprises a tube which has been slit along its length, the longitudinal edges resulting from the slit being welded to the tubing sub in spaced apart condition.

* * * * *